US007251964B2

(12) United States Patent
Wade

(10) Patent No.: US 7,251,964 B2
(45) Date of Patent: Aug. 7, 2007

(54) DOUBLE LOCKING HANDCUFFS

(75) Inventor: Terrence L. Wade, Monticello, ME (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 11/314,499

(22) Filed: Dec. 20, 2005

(65) Prior Publication Data

US 2006/0130538 A1 Jun. 22, 2006

Related U.S. Application Data

(60) Provisional application No. 60/638,209, filed on Dec. 21, 2004.

(51) Int. Cl.
*E05B 75/00* (2006.01)

(52) U.S. Cl. ..... 70/16

(58) Field of Classification Search ..... 70/16, 70/15, 17–19; 119/816; 128/846, 869, 876, 128/878, 879
See application file for complete search history.

(56) References Cited

U.S. PATENT DOCUMENTS 1,014,118 A * 1/1912 Carberry ..... 70/16
1,821,566 A * 9/1931 Neal ..... 70/16
1,845,511 A * 2/1932 Neal ..... 70/16
1,851,206 A * 3/1932 Neal ..... 70/16
3,423,871 A * 1/1969 Foley ..... 70/16
4,138,867 A 2/1979 Tompkins
4,287,731 A * 9/1981 Kruger ..... 70/16
4,314,466 A * 2/1982 Harris ..... 70/16
4,574,600 A * 3/1986 Moffett ..... 70/16
4,768,362 A * 9/1988 Schmalz, Jr. ..... 70/408
5,555,751 A 9/1996 Strickland et al.
5,613,381 A 3/1997 Savage
5,743,117 A * 4/1998 Woo et al. ..... 70/16
5,797,284 A * 8/1998 Lurie ..... 70/16
6,619,077 B1 * 9/2003 Robinson ..... 70/16

FOREIGN PATENT DOCUMENTS

FR 2 827 330 A1 7/2001

* cited by examiner

*Primary Examiner*—Lloyd A. Gall
(74) *Attorney, Agent, or Firm*—McCormick, Paulding & Huber LLP

(57) ABSTRACT

A double locking handcuff includes an interior spring laterally moveable between single- and double-lock positions. A finger-operated, pivoting cam is disposed within a slot extending through the cuff frame, and has a wide upper end accessible from the top of the cuff and a narrow, leg-like lower end positioned for movement against the spring. For double locking the handcuff, the cam upper end is moved downwards by hand. This causes the cam leg to press against and laterally shift the spring to its double-lock position. Because the cam is movable by hand and without the need for the handcuff key or for finding a double lock slot or pinhole, the double lock mechanism can be easily and quickly actuated. Also, when the handcuff is double locked the cam can be freely pivoted back and forth, providing direct tactile feedback that the handcuff is double locked.

20 Claims, 7 Drawing Sheets

DOUBLE LOCKING HANDCUFFS

This application claims the benefit of U.S. Provisional Application Ser. No. 60/638,209 filed Dec. 21, 2004, hereby incorporated by reference in its entirety.

TECHNICAL FIELD

The present invention relates to portable locks and, more particularly, to manacles and cuffs.

BACKGROUND OF THE INVENTION

Manacles, shackles, and handcuffs are portable locking devices used, e.g., by law enforcement personnel, to temporarily but securely bind or restrain suspects and other persons in custody. The basic modern handcuff design has proven very successful both in terms of functionality and low manufacturing costs, and has changed little over the years.

One typical design for double locking handcuffs is shown in U.S. Pat. No. 4,287,731. In the '731 patent, in a central cavity in the handcuff frame, a laterally-moveable spring element biases a pivoting bolt in a downwards direction against the cuff's pivoting jaw. The jaw and bolt have cooperating, oppositely facing ratchet teeth. When "single locked," the jaw can be moved to tighten the cuff, but the bolt prevents the jaw from disengaging in a release direction. The cuff is unlocked entirely simply by using the handcuff key to rotate the bolt out of engagement with the jaw. For double locking the cuff, one end of the key has a small, pin-like protuberance. This is inserted into a small slot in the front of the cuff frame, and is moved from left to right to laterally shift the spring element. Once shifted, the spring element blocks the bolt, preventing it from being moved away from the jaw, while at the same time biasing the bolt against the jaw. In this manner, the jaw cannot move, and the cuff is rendered more difficult to pick or otherwise bypass. (It should be noted that once the spring element is laterally shifted, it lies past the slot and can no longer be engaged by the pin-end of the key.) To unlock the cuff, the key (placed in the keyhole slot) is rotated away from the bolt, contacting and laterally shifting the spring element. Then, the key is rotated the other direction to pivot the bolt away from the jaw.

Other double locking cuff mechanisms replace the slot with a small bore or hole that extends through the side of the frame and into the region of the end of the spring element. To double lock the cuffs, the pin-like end of the key is pushed into the hole to either directly push on the end of the spring element, or to push on an intermediate element (an internal pin) that in turn acts on the spring element.

While these and similar designs have proven to be effective in terms of general operation and robustness, the difficulties faced by law enforcement personnel have revealed the need for improvements in the area of situational functionality. In particular, restraining and handcuffing a suspect is one of the most dangerous and difficult operations faced by law enforcement personnel. Typically, the suspect is less than fully cooperative, and may in fact be making concerted efforts to resist arrest. This will require that the suspect be physically subdued, and even then there may be arm and leg movement.

In such situations, it is difficult in the first place just to position the cuffs for engagement around the suspect's wrists. Moreover, considering the very small size of the key and key pin-end, double locking the cuffs will be even more difficult. First, if not readily available, the handcuff key has to be located, a difficult task with an unruly suspect. Then, two hands may have to be used to hold the key, find the small front or side slot/hole in the cuffs, and maneuver the pin-end into the slot or hole. Such problems are compounded at night or in other low-light situations. Also, considering the potentially fast-moving situation, and in light of the small size of the double lock actuation components (e.g., key and hole or slot), it may not be possible for the officer to tell whether or not the double lock has actually engaged.

Accordingly, a primary object of the present invention is to provide an improved double lock mechanism for handcuffs that can be easily and quickly engaged by a law enforcement officer by hand and without the need for the handcuff key, and that provides a measure of positive feedback to the user indicating that the double lock mechanism has been actuated.

SUMMARY OF THE INVENTION

An embodiment of a double locking handcuff according to the present invention includes a jaw operably connected to a housing (e.g., a front cheek, a frame, and a rear cheek, all respectively stacked atop and connected to one another). The jaw cooperates with a bolt that is pivotally disposed in an interior of the housing. The bolt is biased downwards against the jaw by a bolt spring positioned in the interior space of the housing. The bolt spring can be laterally shifted between a first, "single-lock" position, and a second, "double-lock" position. In the former, the bolt can be disengaged from the jaw upon the application of a force overcoming the biasing effect of the spring. In the latter, the bolt is prevented from disengaging from the jaw, preventing someone from thwarting the cuff by manipulating the bolt. The handcuff further includes a cam pivotally disposed within a slot extending through the housing. The cam is accessible and moveable by hand from the exterior of the housing for laterally shifting or otherwise moving the spring from the single-lock position to the double-lock position.

For example, the cam may comprise a wide upper end and a narrow, leg-like lower end. The upper end of the cam is accessible from the exterior top of the housing, and includes a frictionally textured (e.g., knurled or grooved) surface for aiding in grasping the cam. The lower leg is positioned for movement against the bolt spring. To laterally shift the bolt spring from its single-lock position to its double-lock position, the cam upper end is moved downwards using a thumb or finger. This causes the cam leg to press against and laterally shift the spring.

Because the cam is movable using a single thumb or finger, and without the need for the handcuff key or for finding a double lock slot or pinhole, the double lock mechanism can be easily and quickly actuated by a law enforcement officer or other user even in low-light situations, as well as in situations where two hands are not available or when a suspect is moving or otherwise resisting. Also, the resistance of the spring to movement inside the frame interior space is felt by the user during actuation of the cam, thereby providing positive tactile feedback to the user as to whether or not the handcuff has been double locked: when the handcuff is double locked the cam can be freely pivoted back and forth, and when the handcuff is not double locked the cam is somewhat more difficult to move in its actuation direction.

The present invention is applicable within the context of portable locking devices adapted to the human anatomy generally. As such, by way of the term "cuff" or "handcuff" as used herein it is meant handcuffs, fetters, manacles, nippers, and the like.

BRIEF DESCRIPTION OF THE DRAWINGS

These and other features, aspects, and advantages of the present invention will become better understood with respect to the following description, appended claims, and accompanying drawings, in which:

DETAILED DESCRIPTION

Figure 1:
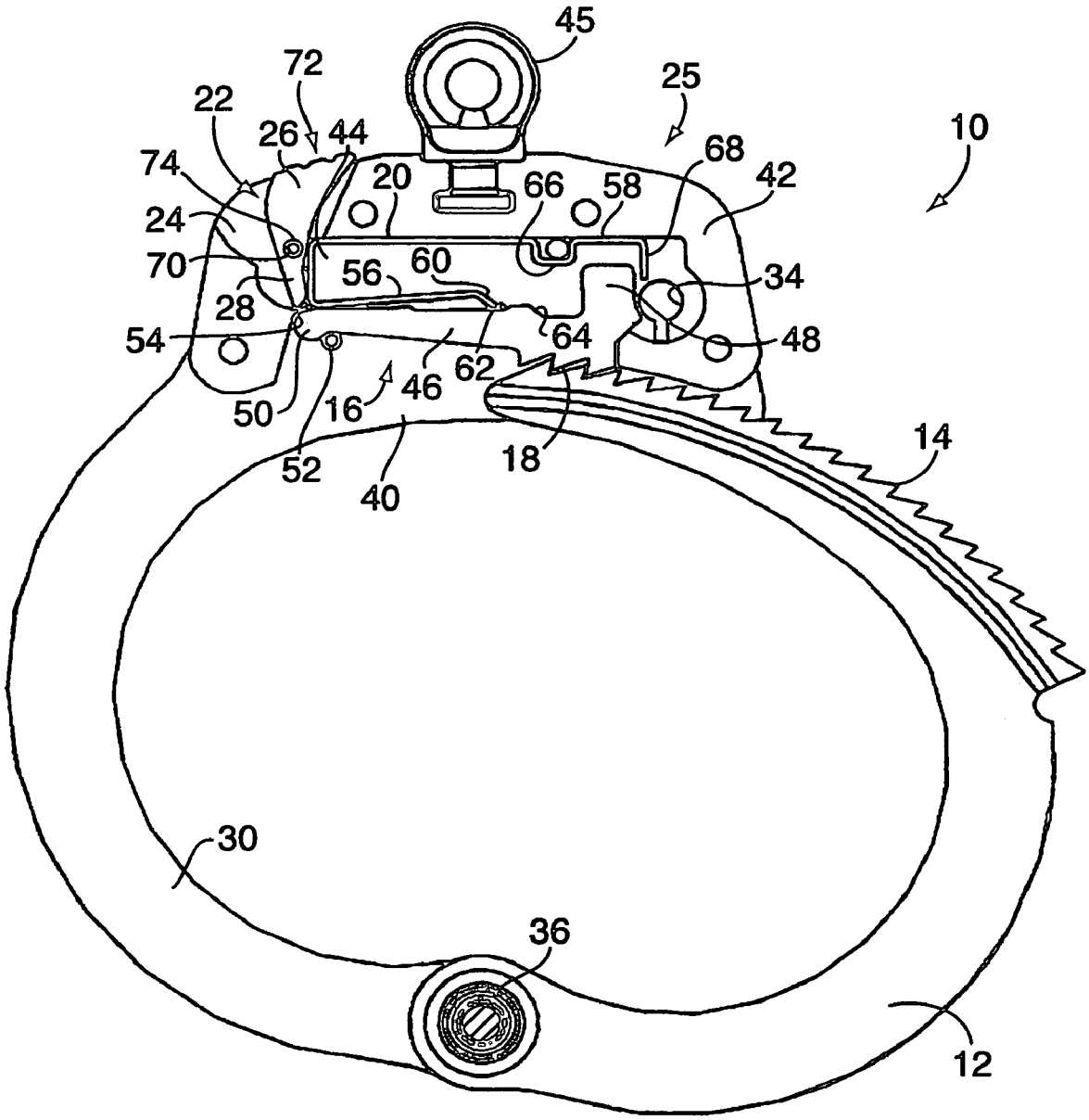
FIG. 1 is a sectional view as seen along lines 1—1 of FIG. 6 of a double locking handcuff according to the present invention, showing the double lock mechanism in an unactuated, "single-lock" position.
Figure 2:
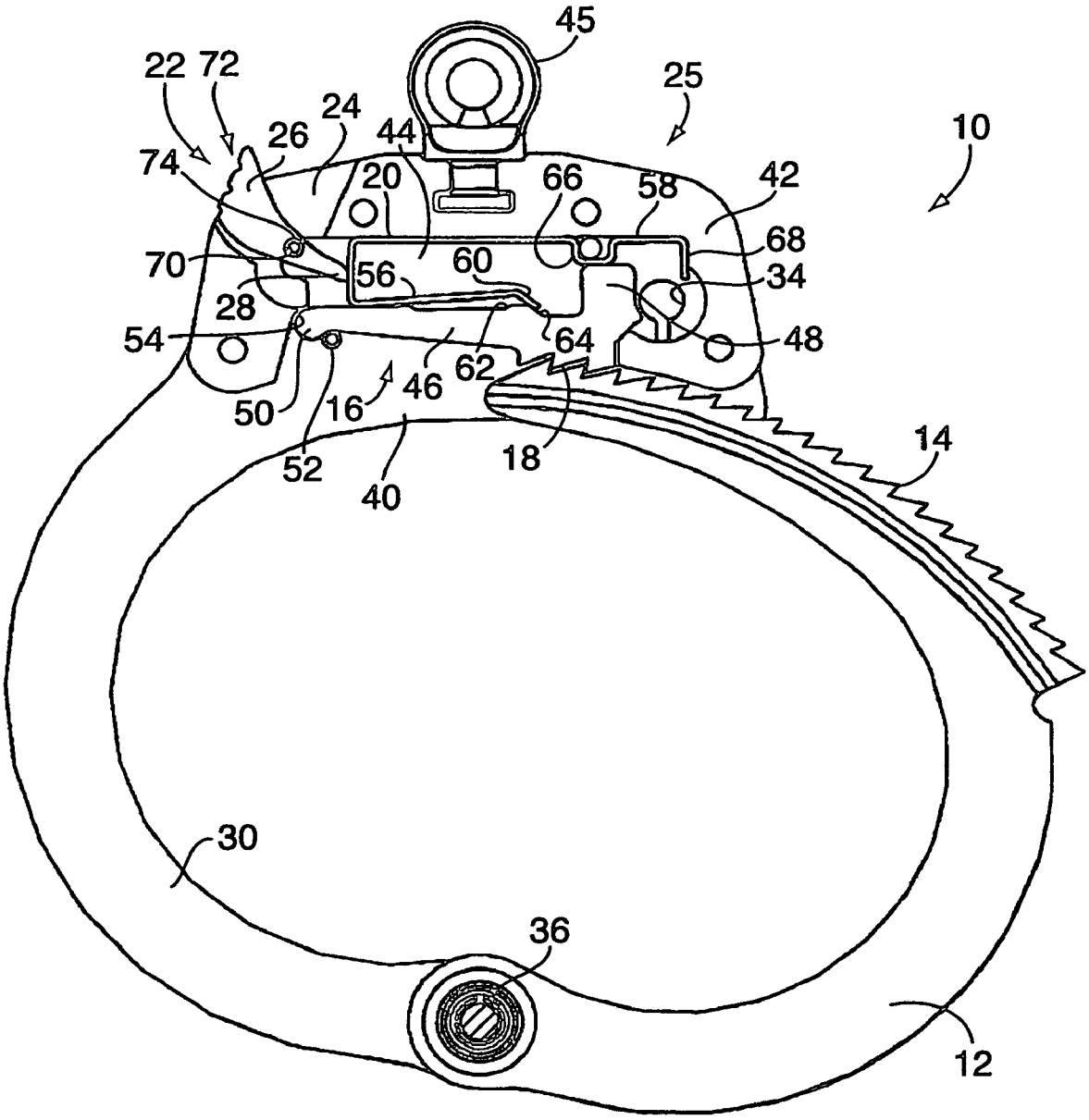
FIG. 2 is a sectional view of the double locking handcuff showing the double lock mechanism in an actuated, "double-lock" position.
Figure 3:
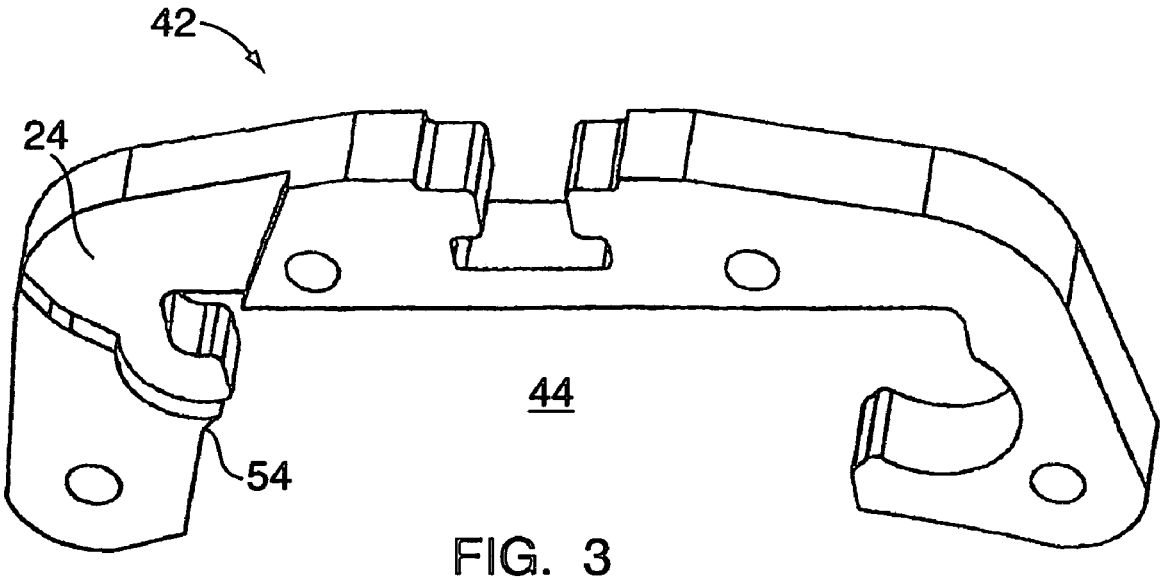
FIG. 3 is a perspective view of a frame portion of the double lock mechanism.

With reference to FIGS. 1–6, an embodiment of a handcuff 10 with double lock mechanism comprises a pivoting jaw 12 with ratchet-like teeth 14 that cooperates with a pivoting bolt 16. The bolt 16 has reverse-facing teeth 18, and is biased downwards against the jaw 12 by a bolt spring 20. The spring 20 is laterally moveable between a first, "single-lock" position, as shown in FIG. 1, and a second, "double-lock" position, as shown in FIG. 2. For double locking the handcuff 10, a hand-operated, pivoting cam member 22 is provided. (By "hand-operated," it is meant that the cam can be directly actuated using a finger or thumb.) The cam 22 is disposed within a slot 24 extending through a cuff housing 25. A wide, upper end 26 of the cam 22 is accessible from the top of the cuff, and a narrower, depending leg portion 28 of the cam 22 is positioned against the spring 20. To laterally shift the spring 20 from its single-lock position to its double-lock position, the cam upper end 26 is moved downwards (counterclockwise from the perspective of FIG. 1) using a thumb or finger. This causes the cam leg 28 to press against and laterally shift the spring 20.

As should be appreciated, because the cam 22 is relatively large in size (e.g., compared to the handcuff key and other components of a typical double lock system) and is hand operated, the handcuff 10 can be quickly and easily double locked by law enforcement personnel even in difficult situations, such as when a suspect is resisting, or at nighttime. As such, instead of having to use two hands to find the handcuff key and maneuver it into the double lock slot or bore, all that is required is for the police officer to rotate the cam 22 using a single finger or thumb.

Also, instead of being uncertain as to whether the double lock mechanism has actually been actuated, as might happen with existing devices if the officer attempts to quickly engage the double lock, the present invention provides positive tactile feedback of double lock engagement. In particular, frictional resistance of the spring 20 prevents the cam 22 from freely pivoting, and a user feels this resistance when moving the cam 22. (By "freely" pivot, it is meant that there is only a slight resistance to movement across the cam's entire range of movement, as provided by the cam pivot and/or friction between the cam and housing.) However, once the spring 20 is fully shifted into the double-lock position, the cam 22 no longer encounters resistance, and can freely pivot in either direction. Thus, if the cam 22 is freely pivotable, the user knows that the double lock mechanism has been actuated, and if not, that the double lock mechanism has not been actuated.

Figure 5:
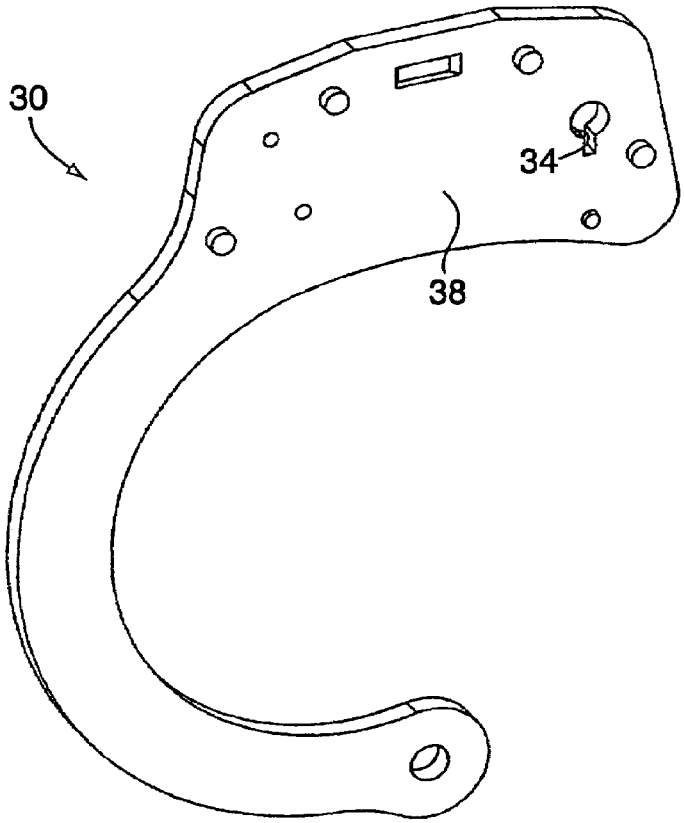
FIG. 5 is a perspective view of a cheek and head portion of the double locking handcuff.
Figure 6:
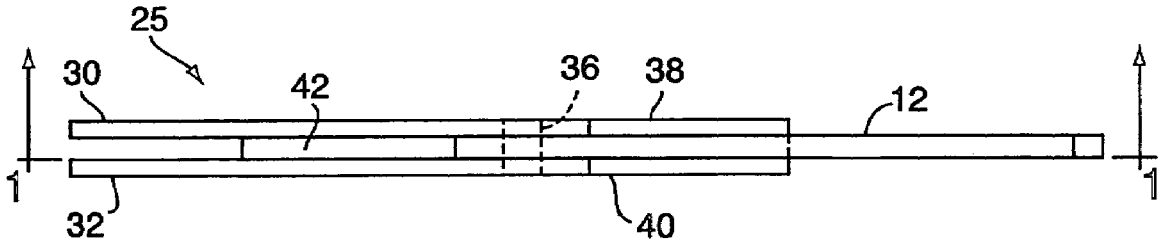
FIG. 6 is a schematic bottom view of the handcuff showing the relation between jaw and cheek portions of the handcuff.

The underlying locking mechanism for the handcuff 10 is generally similar to the one described in above-mentioned U.S. Pat. No. 4,287,731, which is hereby incorporated by reference in its entirety. The cuff 10 includes the generally arcuate jaw 12, which has the ratchet-like teeth 14 at one end and is pivotally connected at its opposite end to the housing 25, and in particular between generally arcuate front and back cheeks 30, 32, respectively. (The front cheek 30 is also shown in FIG. 5; the back cheek 32 is generally similar but without, e.g., a keyhole slot 34.) This pivotal connection between the jaw 12 and cheeks 30, 32 comprises a joint stud 36 suitably secured in recesses formed in the opposed and registering ends of the cheeks 30, 32 and an aperture through the jaw 12.

The cheeks 30, 32 each terminate at their opposite ends in enlarged heads 38, 40, respectively, which form part of the housing 25 and locking mechanism. A frame 42 (see FIG. 3), preferably a metal plate, is disposed between the checks 30, 32, and in particular between cheek heads 38, 40, to form the housing 25. As illustrated, the frame 42 has the same general outline as the cheek heads 38, 40, which straddle the frame 42. Together with the cheek heads 38, 40, the frame 42 defines the slot 24, a lower opening for the bolt 16 to engage the jaw 12, and an interior space or cavity 44 for receiving the spring 20. With respect to the frame 42, the slot 24 comprises a relief or channel on one side of the frame. When the frame 42 is positioned between the cheek heads 38, 40, the slot 24 forms an opening extending from the exterior of the cuff 10 down through to the interior 44. This opening receives the cam 22. Although the housing 25 is shown as comprising the cheeks 30, 32, cheek heads 38, 40, frame 42, interior 44, etc., the housing could be formed in another manner. Accordingly, by "housing" it is meant any sort of body or member with an interior space and openings suitable for use in the context of a handcuff according to the present invention.

The cuff 10 also includes a swivel 45 that is secured to the frame 42 between the cheek heads 38, 40. The swivel 45 projects out past the top of the frame and cheek heads for attachment to a chain and another cuff, not shown, in a conventional manner.

The locking mechanism includes the bolt 16 and the bolt spring 20, both disposed in the interior space 44. The bolt 16 comprises an elongated shank 46, a head 48 having the teeth 18 along its underside for engaging the teeth 14 carried by the jaw 12, and an enlarged, generally circular hub 50 at its end remote from head 48. The bolt 16 is pivotally disposed in the housing 25 by way of a stud 52 secured between the cheek heads 38, 40 and a shaped recess 54 (see FIG. 3) on the frame 24. In particular, the stud 52 extends below the bolt hub 50 and provides a pivotal support therefor. The frame recess 54 is defined by a circular wall portion of the frame that lies on the opposite side of the hub 50 from the stud 52. Thus, the stud 52 and wall 54 define a bearing for the hub 50 and about which the bolt 16 pivots. The bolt may be otherwise pivotally disposed in the housing 25, e.g., a direct pivot connection.

The bolt spring 20 is an elongated, bent or shaped strip of thin metal (or other suitable material) having first and second spring leg portions 56, 58, respectively. When the bolt spring 20 is disposed in the interior space 44, the first spring leg portion 56 bears against the bolt shank 46. This biases the bolt 16 for pivotal movement in a clockwise direction, urging the bolt into a locking position with the bolt teeth 18 engaging the jaw teeth 14. The first spring leg portion 56 is bent near its end to define a tab 60, which cooperates with detents 62, 64 in the top of the bolt 16 to prevent movement of the bolt spring 20 except when the bolt spring is moved by the cam 22 (for moving the spring 20 into its double-lock position) or by the handcuff key (for "unlocking" the spring from its double-lock position).

The second spring leg portion 58 bears against the underside of the frame 42, and carries a protuberance 66 for double locking the bolt 16. Also, the second spring leg portion 58 is bent near its end to terminate in a flange 68 that extends in the direction of the first spring leg portion 56 and includes a recess between the protuberance 66 and flange 68. By comparing FIGS. 1 and 2, as mentioned above, it can be seen that the bolt spring 20 is configured for sliding laterally in the interior space 44 between its single-lock position (FIG. 1) to its double-lock position (FIG. 2).

In order to dose the handcuff 10 for use, the jaw 12 is pivoted counter-clockwise (from the perspective of FIG. 1) so that its free end is moved between the cheeks 30, 32. The spring 20 biases the bolt 16 downwards against and in the path of the jaw 12. However, as the jaw 12 moves between the cheeks, the jaw teeth 14 slide past the bolt teeth 18 in a ratchet-like manner, i.e., the bolt 16 pivots upwards against the spring 20 as the teeth 14, 18 slide over one another. (Note that the bolt head 48 is free to move into the space between the spring protuberance 66 and flange 68.) In this manner, the cuff 10 is single locked: the jaw 12 is free to move counter-clockwise, but not clockwise away from the cheeks 30, 32 for disengagement from the bolt 16.

Figure 4:
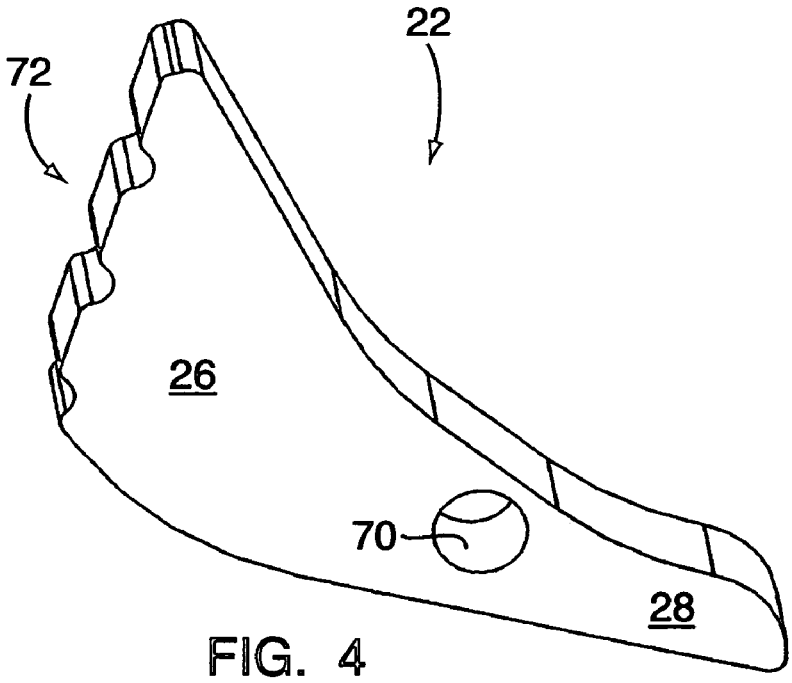
FIG. 4 is a perspective view of a cam portion of the double lock mechanism.

The cam or cam means 22 used for double locking the cuff 10 is shown in detail in FIG. 4. The cam 22 is generally triangular in shape, and comprises the wide upper end 26 and the narrow leg 28 that extends down from the upper end 26. A pivot aperture 70 extends through the cam 22, and is positioned between the upper end 26 and depending leg 28. The top of the upper end 26 may be provided with a frictionally textured surface 72 (ridges, knurling, grooves, or the like) for making the cam 22 easier to grasp. As mentioned above, the cam 22 is pivotally attached to the housing 25 in the frame slot 24, by a pivot pin 74 or the like.

To double lock the handcuff 10 in its closed position, the bolt spring 20 is moved laterally/linearly within the frame interior space 44, from the single-lock position (FIG. 1) to the double-lock position (FIG. 2). To do this, the user actuates the cam 22 by pressing a finger against the knurling 72 and rotating the cam 22 downwards/counter-clockwise. This causes the depending leg 28 to rotate and engage the left side of the spring 20, thereby causing the spring 20 to slide laterally to the right in the interior space 44 and into the double-lock position (compare FIG. 1 to FIG. 2). Because the cam 22 is accessible from the outside top of the cuff 10, and can be easily located and actuated using one finger or thumb and without the need for the handcuff key or other tool, the cuff 10 can be easily and quickly double locked even in low-light, no-light, and similar situations.

The depending leg 28 of the cam 22 is shaped such that when the spring 20 has been urged into its double-lock position, the cam 22 will not be able to re-engage the spring 20 and pull the spring 20 back out of the double-lock position. In other words, once the cam 22 has been fully rotated downwards to laterally shift the spring 20, the spring and cam are disengaged and further movement of the cam 22 (e.g., rotating the cam in the other direction) will have no effect on the spring 20. Also, the cam 22 and slot 24 are correspondingly shaped such that when the cam 22 is in both the single-lock position (FIG. 1) and double-lock position (FIG. 2), the cam 22 substantially blocks the slot 24, generally closing off the interior space 44. (By "substantially" blocked, it is meant that the spring 20 cannot be accessed by hand through the slot.)

Once in the double-lock position, the spring protuberance 66 is located in registry with or opposite the bolt head 48. This prevents the bolt 16 from pivoting towards its unlocked position and the bolt teeth 18 from disengaging from the jaw teeth 14. The bias of the spring 20 serves to maintain the bolt 16 downwardly against the jaw 12 while simultaneously the protuberance 66 prevents the bolt 16 from pivoting upwards. Thus, the spring 20 serves as a double lock for the handcuff 10, preventing the bolt 16 from pivoting and the jaw 12, thereby, from moving in either direction. As should be appreciated, this prevents the cuff from being further tightened (e.g., the jaw 12 cannot rotate counter-clockwise), and it prevents the cuff from being easily picked or bypassed by a suspect attempting to manipulate the bolt through the keyhole slot 34 or under the frame 42.

To unlock the handcuff 10, for moving the jaw 12 clockwise away from the cheeks 30, 32 and frame 42, a standard handcuff key (not shown, but with an end similar in shape to the keyhole slot 34) is inserted into the keyhole slot 34. If the cuff 10 is not double locked (FIG. 1), rotation of the handcuff key clockwise towards the bolt 16 causes the bolt to pivot upwards, disengaging the bolt teeth 18 from the jaw teeth 14. However, if the cuff 10 is double locked (FIG. 2), rotation of the handcuff key clockwise towards the bolt 16 will not cause the bolt to pivot upwards, because of the spring protuberance 66. As such, the handcuff key is first turned counter-clockwise towards the spring flange 68. As the key hits the flange 68 and is further rotated, the spring 20 is caused to shift laterally to the left, from its double-lock position back into the single-lock position, where the spring protuberance 66 is no longer located above the bolt head 48. As the spring 20 is shifted to the left, it hits the cam depending leg 28, causing the cam 22 to rotate clockwise back into its un-actuated, position (FIG. 1). Then, the key is turned in the opposite direction against the bolt 16, as described above, for fully unlocking the cuff 10.

As mentioned above, the bolt detents 62, 64, in conjunction with the spring tab 60, help to maintain the spring 20 in the single-lock or double-lock positions, against inadvertent shifting caused by movement of the cuff 10. In addition to any general friction between the spring 20 and frame 42, the resistance caused by the detents and tab results in a sense of positive feedback upon a user moving the cam 22. Specifically, if the spring 20 is already double locked, the cam 22 can be freely pivoted in either direction. However, if the spring 20 is only single locked, movement of the cam 22 is made more difficult until the spring 20 reaches its double-lock position, at which point the cam 22 becomes freely moveable in either direction. Thus, the contrast between the single-lock position (cam more difficult to move) and the double-lock position (cam free to move in either direction) allows the user to identify when the cuff is double locked and when it is not. Although the tab and detents provide resistance against movement, in the course of double locking and unlocking the bolt spring 20, the handcuff key and cam 22 exert sufficient force to overcome the frictional resistance between the tab 60 and each of the detents 62, 64.

The cuff 10 and its components will typically be made of a strong, relatively lightweight material, such as steel or another metal. The cuff 10 is manufactured and assembled according to standard methods well known to those of ordinary skill in the art.

FIGS. 7 and 8A–8C show an alternative embodiment of a double locking handcuff 80. The handcuff 80 is generally similar in configuration and operation to the handcuff 10 described above. Here, however, the handcuff 80 is provided with a "spring return" cam lever 82 wherein the cam lever automatically returns to an initial or un-actuated position (e.g., a position prior to double locking the cuff) after actuation of the cam lever for double locking the cuff. The cam lever 82, shown in FIGS. 7 and 8B, includes an upper end 84, an integral depending leg 86, and a pivot point 88. The cam lever 82 also includes a relief or channel 90 formed in one lateral side of the cam in the area around the pivot 88.

Figure 7:
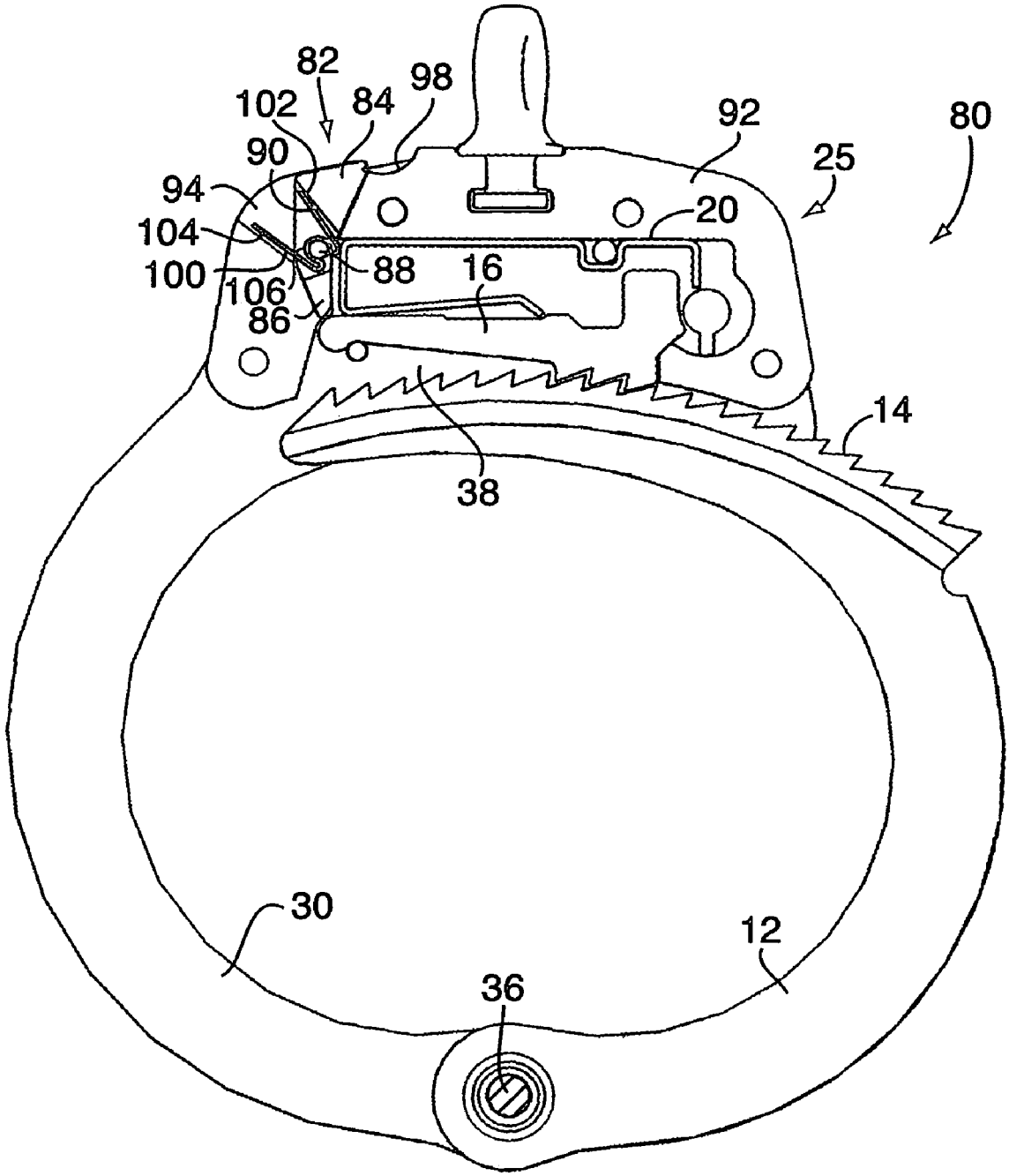
FIG. 7 is a sectional view of an alternative embodiment of the double locking handcuff.
Figure 8A:
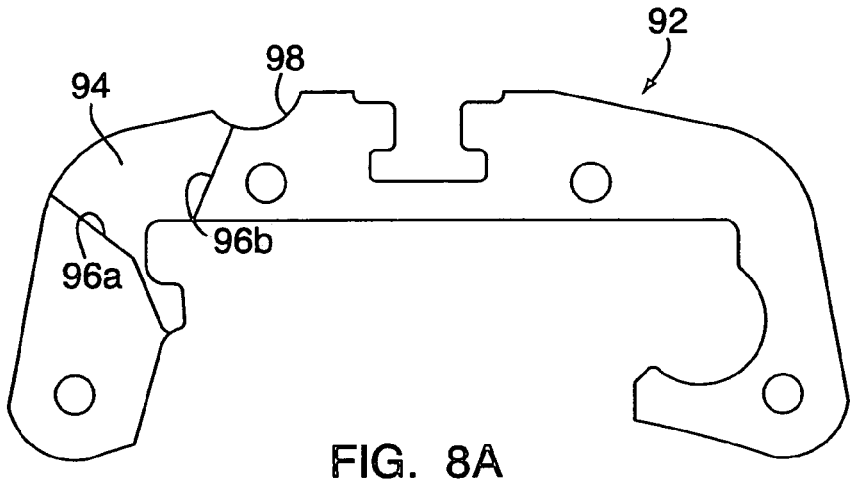
FIG. 8A is a top plan view of a frame portion of the handcuff in FIG. 7.
Figure 8B:
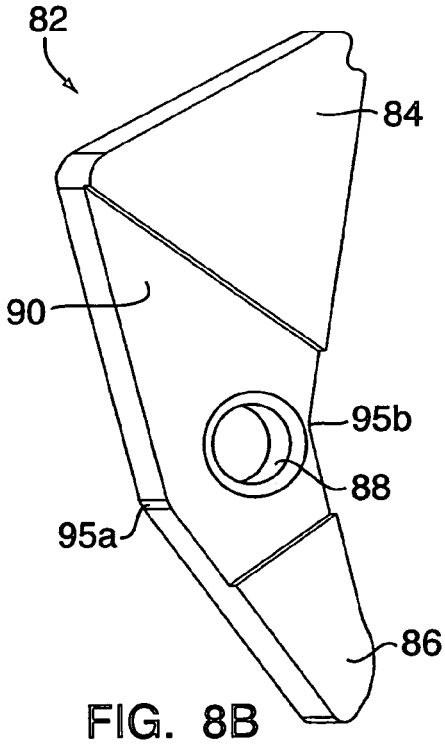
FIG. 8B is a perspective view of a cam lever portion of the handcuff in FIG. 7.

The handcuff 80 further includes a frame 92, as shown in FIGS. 7 and 8A. The frame 92 is generally similar in function to the frame 42 described above, and is disposed between the checks 30, 32, and in particular between cheek heads 38, 40, to form the housing 25. The frame 92 has the same general outline as the cheek heads 38, 40, which straddle the frame 92. When the frame 92 is positioned between the cheek heads 38, 40, a relief or channel 94 on one side of the frame forms an opening or slot extending into the interior of the cuff, said slot receiving the cam 82. The relief/slot 94 is generally similar in function to the slot 24 described above, but in combination with the cam 82 is even better adapted to restricting access to the interior of the cuff through the slot 94. For example, as shown in the figures, the cam leg 86 is disposed at an angle to the cam upper portion 84, with the two juncture points 95*a*, 95*b* therebetween in effect forming pivot-like relations with corresponding shoulders 96*a*, 96*b* on the frame 92 during rotation or pivoting of the cam 82 in the slot 94. The frame 92 may also include a fingernail cut or relief 98 for facilitating access to the cam 82.

Figure 8C:
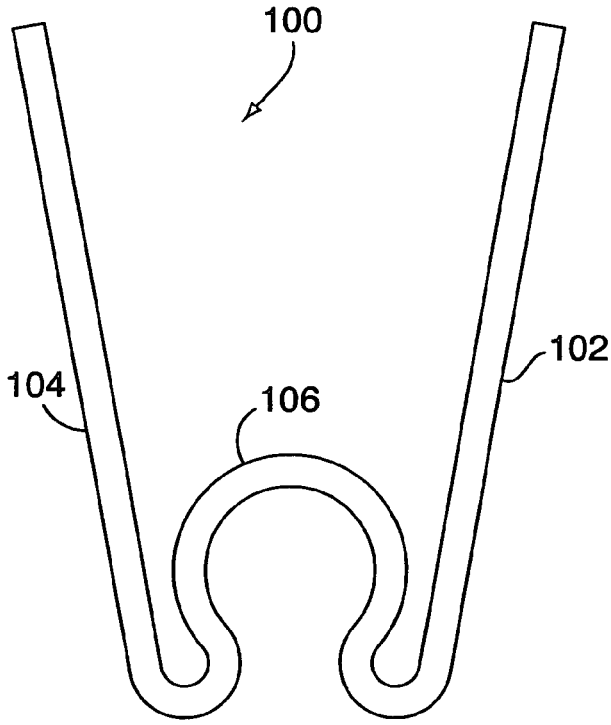
FIG. 8C is a top plan view of a cam lever return spring.

The handcuff 80 further includes a return spring 100 or similar biasing member or cam biasing means for automatically returning the cam 82 to an initial or un-actuated position after actuation of the cam lever for double locking the cuff. As shown in FIGS. 7 and 8C, the return spring 100 is a torsion type spring. The spring 100 includes two leg portions 102, 104 and a center, C-clip like portion 106 which together define a single operational plane for compactness. Alternatively, a conventional torsion spring could be used, e.g., one with a spiral wrapped center portion, as could other biasing mechanisms. For use, the C-clip center portion 106 of the spring 100 is disposed about the cam lever pivot 88 as shown in FIG. 7, with the spring legs 102, 104 pressing against the frame 92 on one side (specifically, a side wall of the slot 94) and against the cam 82 (specifically, a side wall of the relief/channel 90) on the other side. The spring 100 is prevented from exiting the slot 94 by virtue of being disposed about the pivot 88, and is prevented from lateral displacement by the frame and cheek head. In operation, the spring 100 biases the cam 82 into an initial position as shown in FIG. 7. For double locking the cuff 80, the cam 82 is moved manually using a finger or thumb, against the action of the spring 100. Once the bolt spring 20 is moved to the double lock position, and absent the user holding the cam 82 in place, the return spring 100 returns the cam 82 to the initial position. (Although the cam 82 returns to its initial position upon double locking and will not be freely moveable, it should be noted that a user will still be able to determine that the cuff is double locked by way of the cam 82, because there will still be less resistance on the cam with the bolt spring 20 in the double lock position.)

Figure 9A:
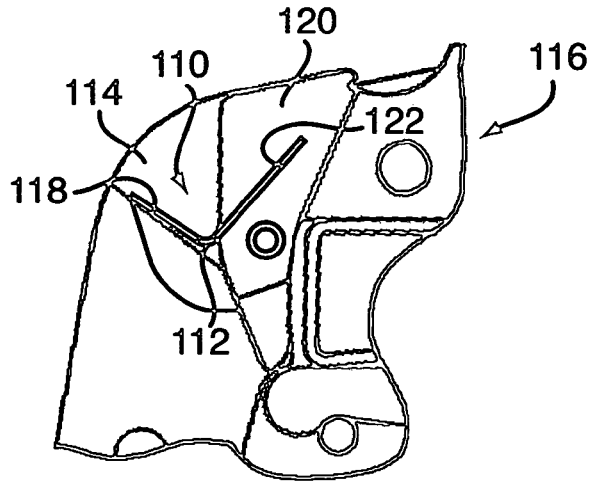
FIGS. 9A–9C show an alternative embodiment of the cam lever return spring arrangement.
Figure 9B:
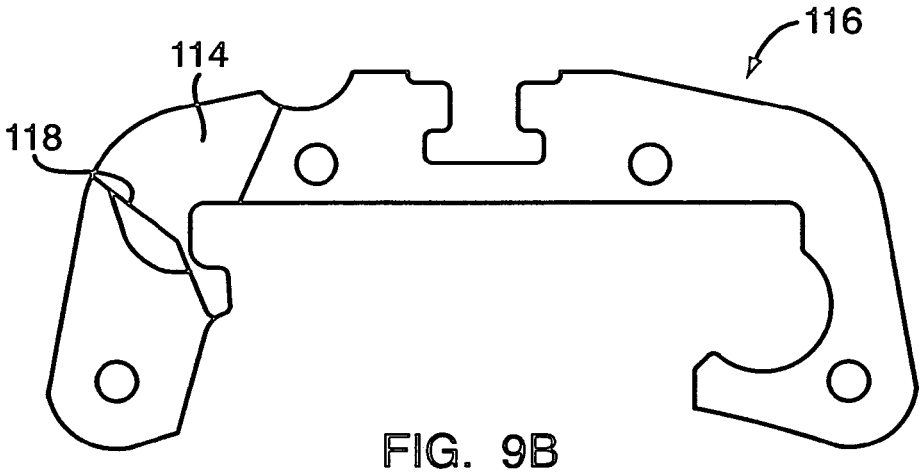
Figure 9C:
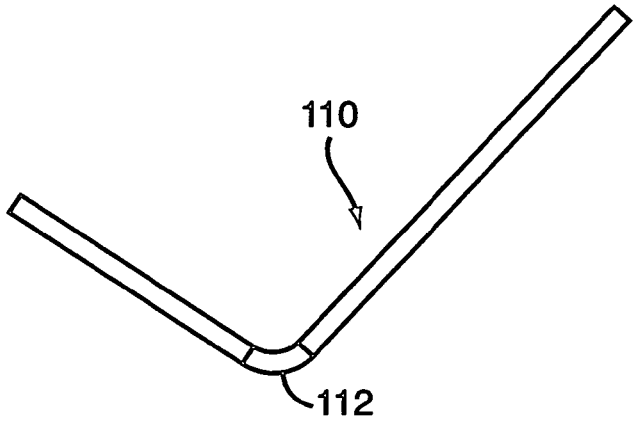

FIGS. 9A–9C show an alternative embodiment of the return spring mechanism. Here, the return spring mechanism is generally similar to the mechanism described above with reference to FIGS. 7–8C. However, instead of having a return spring with a C-shaped center portion that fits around the cam pivot, a generally L-shaped torsion spring 110 is used. The spring 110 may comprise a short length of spring metal bent into an L-shape and having a flexible, spring-like elbow 112 that allows the legs of the spring to flex towards or away from one another upon the application of an external force, and to subsequently spring back into place as generally shown in FIG. 9C upon the removal of the external force. The spring 110 is positioned in a relief or channel 114 of a frame 116, as shown in FIG. 9A. (Similar to as described above, when assembled the relief/channel 114 forms a slot extending from the exterior of the cuff into the interior of the cuff.) One leg of the spring abuts a shoulder 118 of the relief/channel 114. The other leg cooperates with a cam lever 120. In particular, the leg may be positioned in a complementary shaped and appropriately positioned bore 122 provided in the cam 120, or it may abut an angled shoulder provided on one lateral side of the cam, e.g., as shown in the cam in FIG. 8B. In operation, the cam 120 normally lies as shown in FIG. 9A. Pivotal movement of the cam in a counter-clockwise direction (from the perspective of FIG. 9A) causes the spring 110 to flex. When the cam is released, e.g., after moving the bolt spring into the double lock position, the spring 110 returns to its original shape, causing the cam 120 to return to its original position.

Since certain changes may be made in the above described double locking handcuffs, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A double locking handcuff comprising:

a housing having an interior cavity;

a bolt pivotally disposed in the housing interior cavity and having an upper head portion extending into said housing interior cavity and an opposed lower surface;

a jaw operably connected to the housing having a generally arcuate outer surface with a geometry configured to cooperatively engage said lower surface of said bolt;

a spring disposed in the housing interior cavity and configured for biasing the bolt against the jaw when the jaw is brought into cooperation with the bolt, wherein the spring is laterally shiftable within said interior cavity between a single-lock position allowing the bolt to disengage from the jaw upon the application of a force overcoming the biasing effect of the spring and a double-lock position preventing the bolt from disengaging from the jaw; and a manually depressible cam pivotally attached to said housing, said cam having an outer surface configured for manual engagement and an actuating surface opposed to said cam outer surface for engaging said spring wherein rotation of said cam laterally shifts said spring from the single-lock position to the double-lock position within said housing interior cavity.

2. The handcuff of claim 1 wherein upon moving the cam for laterally shifting the spring from the single-lock position to the double-lock position, the cam no longer engages said spring and becomes freely pivotal.

3. The handcuff of claim 1 wherein:

the cam is pivotal from a first position to a second position for laterally shifting the spring from the single-lock position to the double-lock position;

prior to pivoting the cam from the first position to the second position for laterally shifting the spring from the single-lock position to the double-lock position, the cam is cooperative with the spring and is prevented from freely pivoting between the first and second positions by resistance of the spring to movement in the interior cavity; and upon pivoting the cam from the first position to the second position for laterally shifting the spring from the single-lock position to the double-lock position, the cam becomes freely pivotal between the first and second positions, thereby providing tactile feedback that the spring is in the double-lock position.

4. The handcuff of claim 3 wherein the cam is dimensioned to substantially block a slot at a point of opening into the housing interior cavity when in the first or second positions or there between.

5. The handcuff of claim 1 wherein upon moving the cam for laterally shifting the spring from the single-lock position to the double-lock position, the cam disengages from the spring, whereby subsequent movement of the cam has no effect upon the position of the spring prior to the spring being moved back to the single-lock position by way of a key.

6. The handcuff of claim 1 wherein the spring lies disengaged from the cam when in the double-lock position, whereby subsequent movement of the cam has no effect upon the position of the spring prior to the spring being moved back to the single-lock position by way of a key.

7. The handcuff of claim 1 wherein the cam comprises a frictionally textured first portion manually accessible from an exterior of the housing and a second portion integral with the first portion and located on an opposite side of a pivot point of the cam from the first portion, wherein movement of the first portion causes the cam to pivot and the second portion to press against the spring for laterally shifting the spring from the single-lock position to the double-lock position.

8. The handcuff of claim 1 wherein:

the housing comprises a frame disposed between and connected to first and second cheeks, said frame and cheeks defining the interior cavity, and an opening; and the jaw is pivotally connected between the first and second cheeks.

9. The handcuff of claim 1 wherein:

the cam is moveable between first and second positions that define an entire range of movement of the cam; and the cam is dimensioned to substantially block a slot at a point of opening into the housing interior cavity when in the first and second positions and there between.

10. The handcuff of claim 1 wherein:

the cam is moveable between a first position, and a second position for laterally shifting the spring to the double-lock position; and the handcuff further comprises a biasing member operably connected to the cam for biasing the cam towards the first position.

11. The handcuff of claim 10 wherein the biasing member comprises a selected one of: a torsion spring having a C-shaped center portion and two legs attached to the center portion, said torsion spring being disposed about a pivot of the cam; and an L-shaped spring member cooperative with the cam and housing for biasing the cam towards the first position.

12. A double-locking handcuff comprising:

a housing;

a jaw operably connected to the housing having a generally arcuate outer surface with a geometry configured to cooperatively engage with a bolt;

said bolt operably disposed in the housing for engaging the jaw and having an upper head portion extending into said housing and an opposed lower surface which engages said jaw outer surface;

a spring disposed in the housing for biasing the bolt against the jaw, wherein the spring is moveable between a first position allowing disengagement of the bolt from the jaw and a second position preventing disengagement of the bolt from the jaw; and manually depressible cam means connected to the housing, said cam means having an outer surface configured for manual engagement and an actuating surface opposed to said cam outer surface for engaging said spring wherein rotation of said cam means moves said spring from the first position to the second position within said housing.

13. The handcuff of claim 12 wherein:

the cam means is moveable between an initial position and an actuated position for moving the spring to the second position; and the handcuff further comprises cam biasing means for biasing the cam means towards the initial position.

14. A double locking handcuff comprising:

a housing having an interior cavity;

a spring disposed in the interior cavity and moveable between a single-lock position and a double-lock position; and a manually depressible cam operably connected to the housing, said cam having an outer surface configured for manual engagement and an actuating surface opposed to said cam outer surface for engaging said spring wherein rotation of said cam moves said spring from the single-lock position to the double-lock position.

15. The handcuff of claim 14 wherein when the spring is in the double-lock position the cam is freely pivotal for providing tactile feedback that the spring is in the double-lock position.

16. The handcuff of claim 15 wherein the cam is prevented from freely pivoting when the spring is in the single-lock position.

17. The handcuff of claim 14 wherein:

the cam is pivotally disposed in a slot of the housing that extends from an exterior of the housing to the interior cavity;

the cam is moveable between first and second positions that define an entire range of movement of the cam; and the cam is dimensioned to substantially block the slot at a point of opening into the housing interior cavity when in the first or second positions or there between.

18. The handcuff of claim 14 wherein:

the cam is moveable between first and second positions for moving the spring to the double-lock position; and the handcuff further comprises a biasing member for biasing the cam towards the first position.

19. The handcuff of claim 18 wherein the biasing member comprises a selected one of: a torsion spring having a C-shaped center portion and two legs attached to the center portion, said torsion spring being disposed about a pivot of the cam; and an L-shaped spring member cooperative with the cam and housing for biasing the cam towards the first position.

20. A double-locking handcuff comprising:

a housing containing an interior space, a generally arcuate cheek connected to said housing;

a jaw operably connected to the housing having a generally arcuate outer surface with a geometry configured to cooperatively engage a bolt, and said bolt having an upper head portion extending into said interior space and an opposed lower surface that is selectively engageable with the jaw;

said bolt being substantially moveable within said interior space;

a bolt spring in the interior space of said housing, said spring having a recess and a protuberance adjacent to each other at one end; and a manually depressible cam, pivotable about a pivot pin, which has an outer surface configured for manual engagement and an actuating surface opposed to said cam outer surface for engaging said spring wherein rotation of said cam laterally shifts said spring from a position where said upper head portion of said bolt is displaceable when in registration with said recess to a position where said upper head portion of said bolt is not displaceable when in registration with said protuberance.

* * * * *